United States Patent [19]

Rozmestor

[11] Patent Number: 4,711,353

[45] Date of Patent: Dec. 8, 1987

[54] SOCKET ORGANIZER

[76] Inventor: Raymond L. Rozmestor, P.O. Box 1241, Delran, N.J. 08075

[21] Appl. No.: 858,166

[22] Filed: May 1, 1986

[51] Int. Cl.[4] ..... B65D 85/28

[52] U.S. Cl. ..... 206/378; 206/303; 206/372; 206/486; 211/69

[58] Field of Search ..... 206/3, 303, 372, 373, 206/376, 377, 378, 329, 562, 563, 486, 443; 224/253, 904; 211/68, 70.6, 69

[56] References Cited

U.S. PATENT DOCUMENTS

| | | | |
|---|---|---|---|
| D. 225,272 | 11/1972 | Wheeler . | |
| D. 256,425 | 8/1980 | Hayes . | |
| 1,961,450 | 6/1934 | Peterson . | |
| 2,795,323 | 6/1957 | Amundsen | 206/3 |
| 2,995,280 | 8/1961 | Thierry . | |
| 3,004,270 | 10/1961 | Cowley . | |
| 3,113,689 | 12/1963 | Moussong | 206/3 |
| 3,153,500 | 10/1964 | Pachmayr et al. | 206/3 |
| 3,405,377 | 10/1968 | Pierce | 206/378 |
| 3,813,987 | 6/1974 | Minneman | 206/3 |
| 4,150,746 | 4/1979 | Buglione . | |
| 4,154,340 | 5/1979 | Beebe | 206/372 |
| 4,174,037 | 11/1979 | Chow | 206/378 |
| 4,621,738 | 11/1986 | Delucchi | 206/378 |

OTHER PUBLICATIONS

"Socket Organizer", Exhibit A.

*Primary Examiner*—Stephen Marcus
*Assistant Examiner*—David T. Fidei
*Attorney, Agent, or Firm*—Fleit, Jacobson, Cohn & Price

[57] ABSTRACT

An organizer particularly for a set of wrench sockets has a series of socket receivers arranged in ascending-/descending size order. Each receiver is of tubular form which is slit longitudinally to make it expandable and contractable. A resilient band encircles the receiver so that when a socket of suitable size is inserted therein, the resilient band provides a contracting force retaining the socket in the receiver. Also, the receivers have stops to limit the amount of insertion of a socket and the respective stops are arranged at different heights related to the height of the respective sockets so that each socket projects from its respective receiver to the same level above the top of the organizer. In one form of the invention, the stops are provided with respective ejector mechanisms for facilitating removal of the sockets.

14 Claims, 10 Drawing Figures

SOCKET ORGANIZER

BACKGROUND and SUMMARY OF THE INVENTION

This invention relates to article holders in general and more particularly to organizers for holding a set of articles, generally articles of ascending and descending size, in such a manner that the articles will be securely retained in the holder while being readily identifiable and available for use.

Article holders in accordance with the invention are particularly useful, for example, for holding sets of small operating tools such as wrench sockets, however, the invention is also applicable to use for holding and retaining numerous other forms of tools, and like articles such as medicine bottles and the like.

There is a particular need, for example, for an organizer which will securely retain a set of work tools such as wrench sockets of ascending and descending sizes in a manner whereby the articles are readily available to a user, so that they may be removed and replaced from the holder by feel, and wherein they may be organized in the holder in an ascending and descending orientation so that, should the user remove an incorrect size article, the next size up or down will be readily available adjacent the article removed.

Organizers of this type also fulfill a need in other work tool and like applications.

Applicant is aware of the following U.S, patents relating to holders and organizers for wrench socket and like articles. None of these patents, however, discloses article holders having the particular features of construction of the present invention.

| | | |
|---|---|---|
| 1,961,450 | T. Petersen | June 5, 1934 |
| 2,995,280 | P. J. Thierry | Aug. 8, 1961 |
| 3,004,270 | W. E. Cowley | Oct. 17, 1961 |
| 3,405,377 | J. B. Pierce | Oct. 8, 1968 |
| 4,150,746 | V. A. Buglione | Apr. 24, 1979 |
| 4,154,340 | R. W. Beebe | May 15, 1979 |
| Des. 225,272 | R. W. Wheeler | Nov. 28, 1972 |
| Des. 256,425 | J. T. Hayes | Aug. 19, 1980 |

Broadly stated, an articl holder in accordance with the present invention comprises a housing having a base wall and a top wall defining a hollow space therebetween, an opening in the top wall, an article receiver of tubular form located in the hollow space with the opening defining an open end of the receiver, the receiver being slit longitudinally to make it radially expandable and contractable, and the holder further including resilient means embracing the receiver for exerting an inwardly directed radial contraction force on the receiver resiliently resisting radial expansion thereof so that an article of suitable size inserted into the receiver may be frictionally retained therein by resilient expansion of the receiver and the resilient means. For a cylindrical article such as a wrench socket, the receiver is of circular cross section tapering radially inwardly from said one end toward the opposite end with the resilient means in the form of at least one endless band of resilient material surrounding the receiver. The holder may further include an article stop extending from the base wall into the opposite end of the receiver for determining the level to which the article projects from the top wall of the holder when inserted into the receiver.

For use as an organizer for a set of different size articles such as wrench sockets, the holder includes plural openings, article receivers, and stops as aforesaid for the articles, the respective openings and receivers being sized to retain the different size articles and preferably being arranged in ascending/descending order, the heights of the respective stops above the base wall being related to the lengths of the respective articles so that the articles each project above the top wall substantially to the same level. This arrangement enables the articles to be securely frictionally retained in the respective receivers but readily removed when required.

In one form of the invention, the respective stops may be provided with ejector mechanisms including a pushbutton projecting from the top plate of the holder and a lever linkage connecting the pushbutton to the respective stop so that the stop is elevated to eject an article responsive to depression of the pushbutton.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
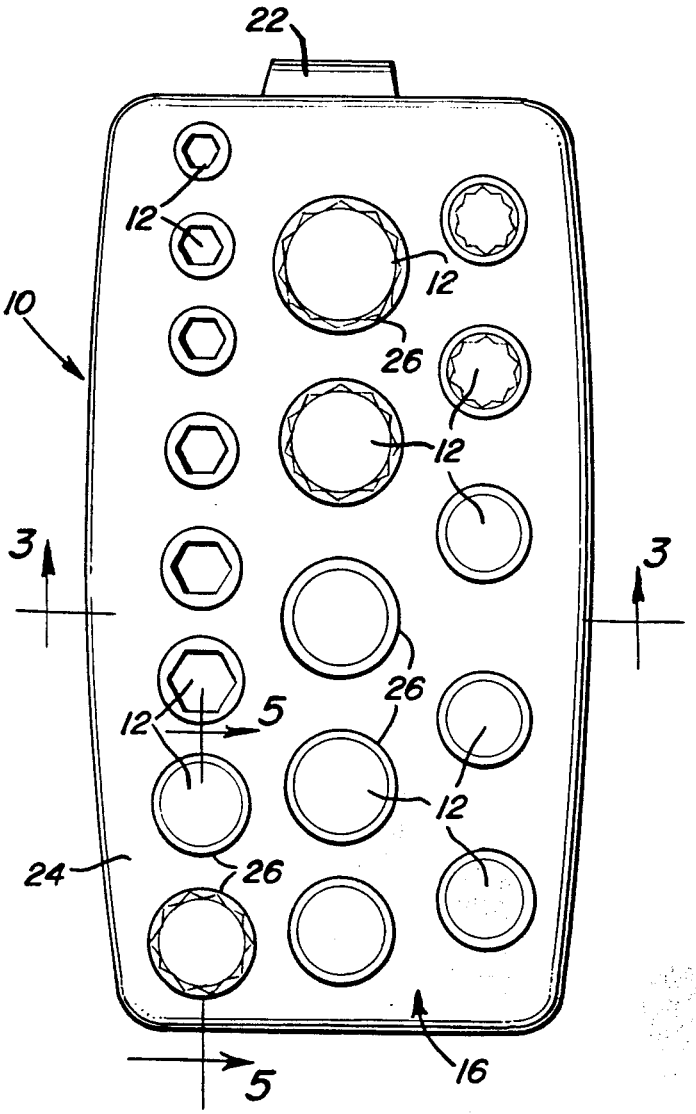
FIG. 1 is a plan view of a first embodiment wrench socket organizer in accordance with the invention.
Figure 2:
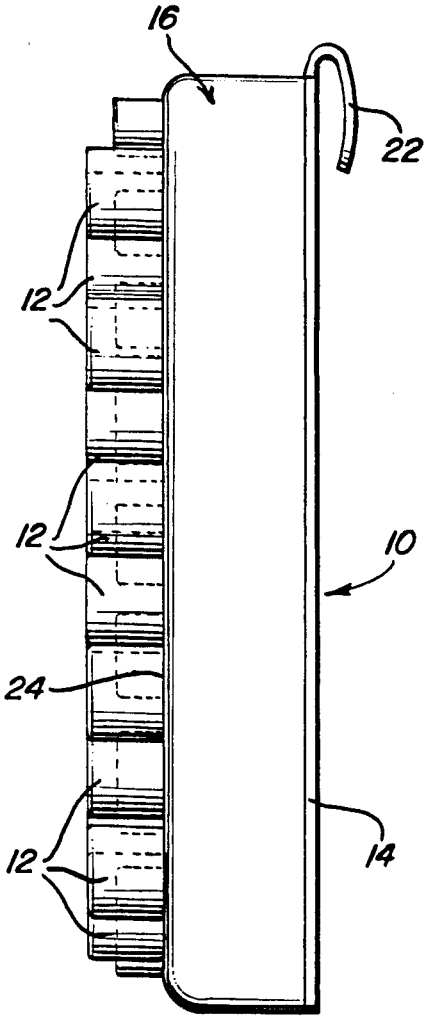
FIG. 2 is an elevational view of the organizer as shown in FIG. 1.
Figure 3:
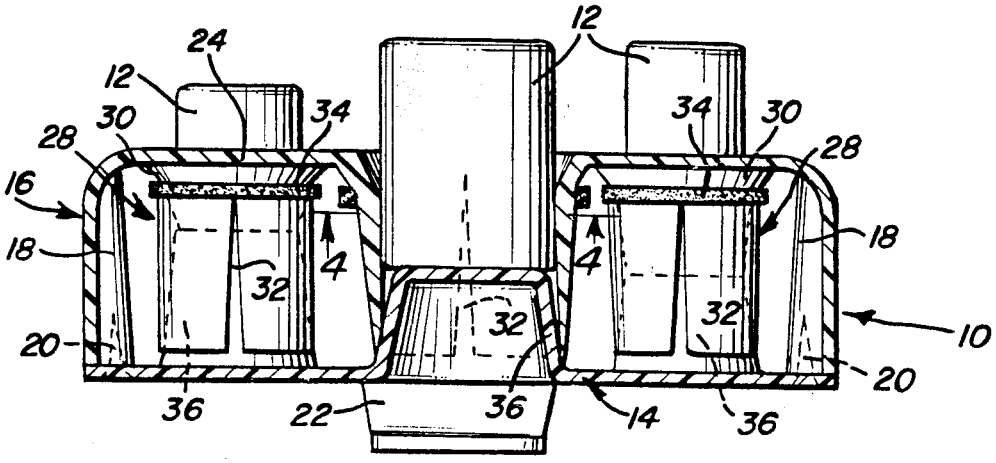
FIG. 3 is a sectional view on line 3—3 of FIG. 1.

Referring initially to FIGS. 1-5, there is shown a first embodiment article holder in accordance with the invention in the form of a flattish substantially rectangular organizer 10 for a set of wrench sockets 12. It will be evident more particularly from FIG. 1 that the sockets are retained in the organizer in ascending/descending size order in three longitudinal rows.

The organizer may, for example, comprise a base member 14 and a dish-like lid member 16, both the base and lid members, for example, being of molded plastic. The lid member may, for example, be provided with suitable internal ribs 18 whereby the base member is secured thereto by screws 20 or the like. The base member may be provided with an integral belt hook 22.

Figure 4:
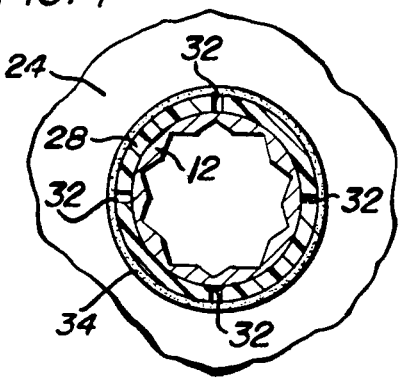
FIG. 4 is a sectional view on line 4—4 of FIG. 3.

Lid member 16 has a top wall 24 which is formed with rows of openings 26 of respectively different sizes to suit the sizes of the respective wrench sockets. Each opening 26 in the top wall defines one open end of a tubular socket receiver 28 located in a hollow space defined between top wall 24 and base member 14. The tubular receivers, which in the illustrated embodiment are of circular cross section, may be integrally molded with lid member 16 or alternatively they may be separate elements suitably secured to the under surface of wall 24 around the respective openings 26. The receivers 28 taper inwardly toward the base 14 and additionally have a neck portion 30 adjacent the opening 26 which is of increased taper. Further, the receivers are slit longitudinally by slits 32 to make them radially contractable and expandable. As shown in FIG. 4, there may be four slits per receiver. In order to exert a radially inwardly directed resilient contracting force on the respective receivers, each receiver is provided with an encircling band 34 of resilient or elastic material. The band is located at the base of neck portion 30 of the respective receiver and exerts a resilient contracting force thereon. Preferably, the bands 34 have flat engagement surfaces with the respective receivers to prevent the bands rolling down the tapered outer surfaces of the respective receivers.

Figure 5:
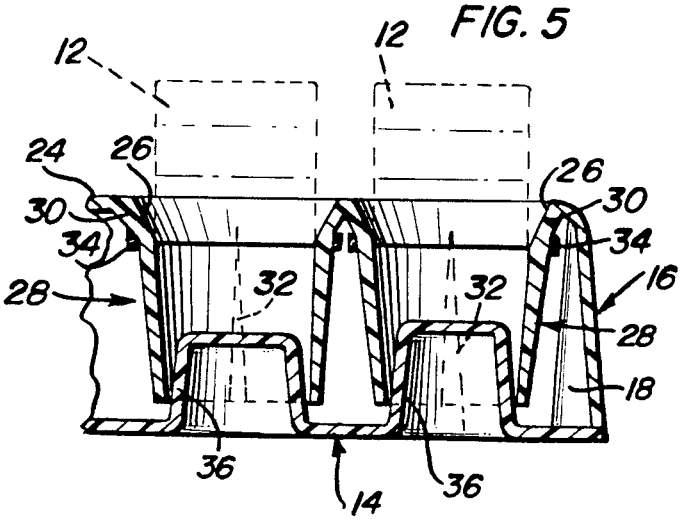
FIG. 5 is a sectional view, somewhat enlarged, on line 5—5 of FIG. 1.
Figure 8:
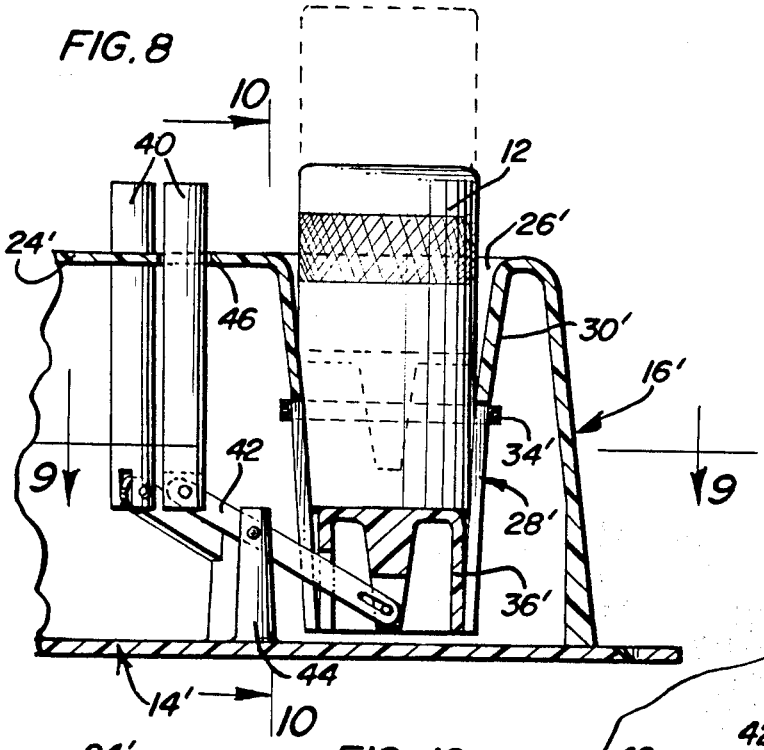
FIG. 8 is a sectional view on line 8—8 of FIG. 6.
Figure 9:
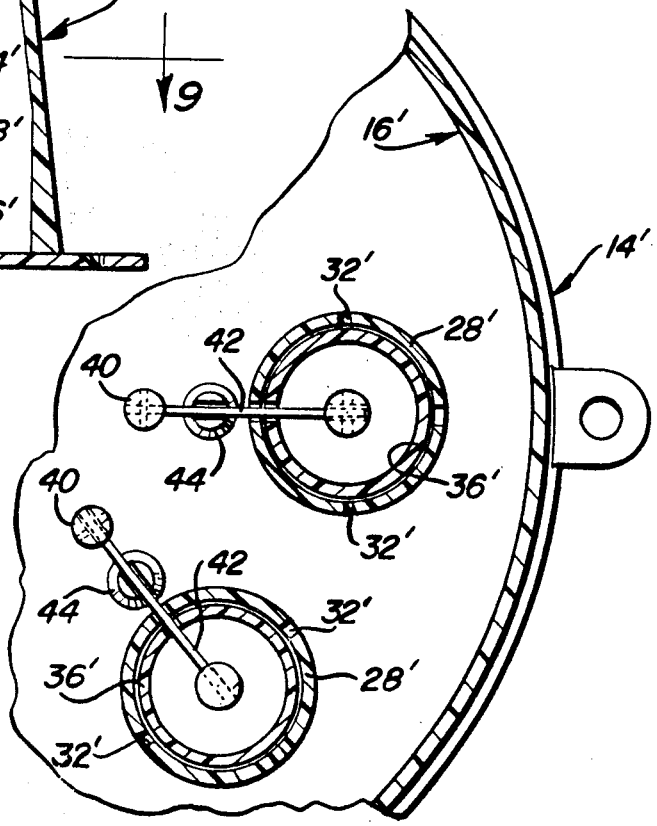
FIG. 9 is a sectional view on line 9—9 of FIG. 8.
Figure 10:
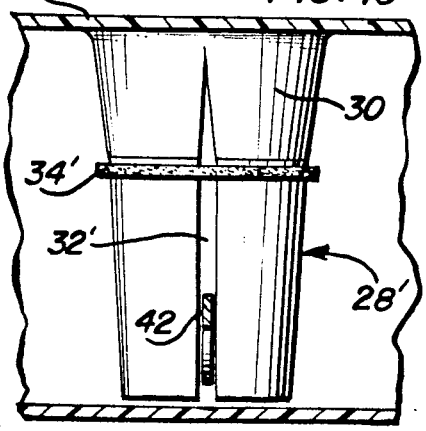
FIG. 10 is a sectional view on line 10—10 of FIG. 8.
Figure 6:
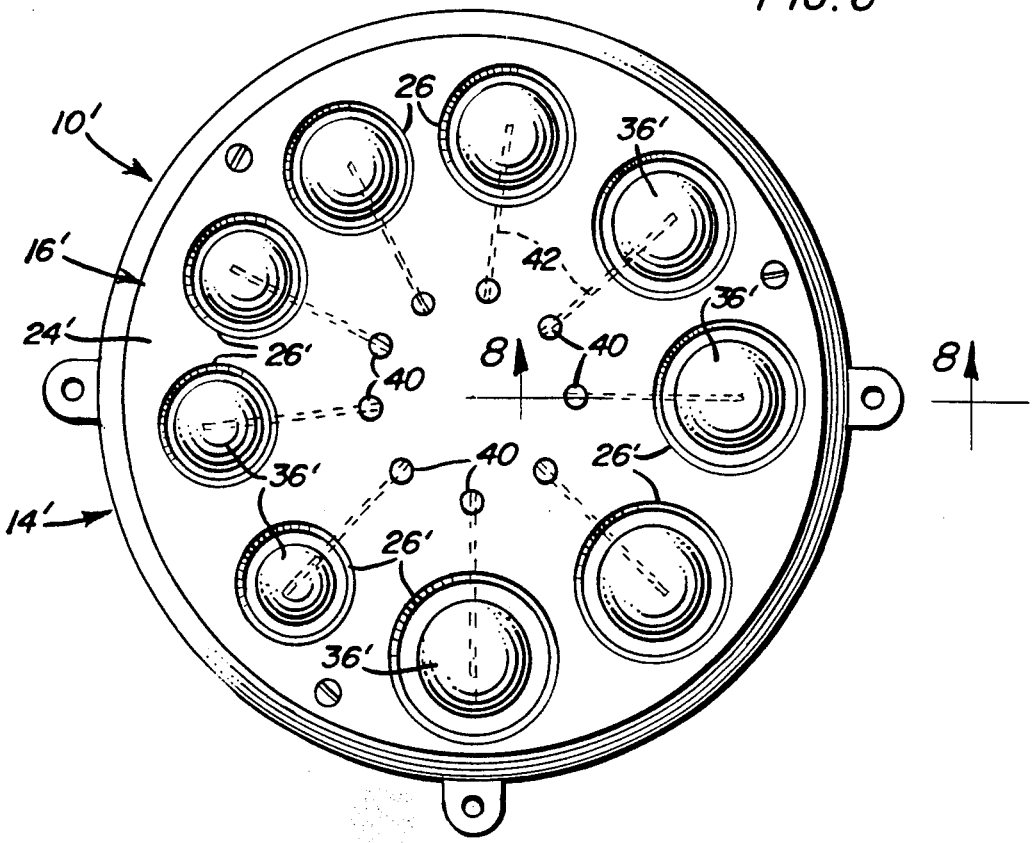
FIG. 6 is a plan view of a second embodiment wrench socket organizer in accordance with the invention.
Figure 7:
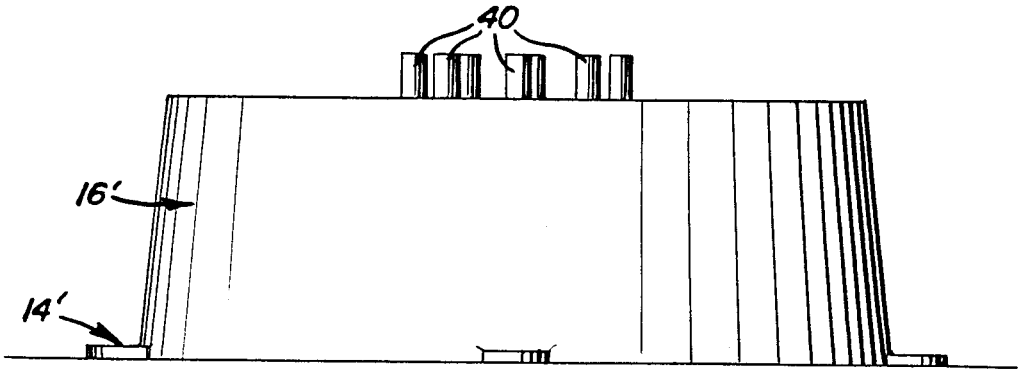
FIG. 7 is an elevational view of the organizer shown in FIG. 6.

Base 14 of the organizer is provided with upwardly directed stops 36 which project into the lower ends of the respective receivers 28 thereby limiting the amount of insertion of the respective sockets 12. Further, the stops may be adapted in height to the respective receiver diameters and related to the sizes of the sockets 12 in the socket set so that sockets of different height when inserted in their respective receivers down to the level of the stops will project above wall 24 to the same level, as shown in FIG. 5. Where it will be evident that the height of the respective stops 36 shown therein is different in order to set the respective sockets at the same degree of projection above wall 24.

The respective openings 26 and receivers 28 are designed to receive respective sockets which are approximately the same nominal diameter as the bottom of the receiver necks 30. Accordingly, because the receivers taper downwardly when a socket is inserted into a receiver, it resiliently expands the receiver against the contraction force exerted by band 34 whereby when the socket is pressed fully home, the band 34 and the outer wall of the receiver exert an inwardly directed resilient retaining force on the socket preventing it from falling out of the receiver and securely retaining it therein until it is withdrawn by pulling same from the top.

It will be evident that the device described provides a convenient form of socket organizer which can either be carried by a workman using the belt hook 22 or which can be suspended from a convenient location. By arranging the sockets in ascending/descending size order, should a workman remove a particular socket then then find that he needs the next one in size, in either direction, this can be readily located by feel. It is also to be understood that while the organizer has been specifically described for use with a set of wrench sockets, a similar construction is also useful for holding other articles. Article holder structures in accordance with the invention can also be incorporated in other appliances such as tool boxes, trays, drawers, cases and the like. Further, while the openings 24 and the receivers 28 have been shown and described as of circular cross section, this is to suit their application for retaining wrench sockets. For other shaped articles, the receivers and openings could have a different shape, for example, rectangular, with longitudinally slit walls, in which case, the peripheral contraction means corresponding to bands 34 need not necessarily be endless so as to encircle the entire receiver but, for example, channel-shaped clips could be used as the contraction aids for rectangular-shaped receivers. In a further modification, one or more of the stops 36 may be eliminated, and taller sockets or the like may engage directly against base walll 14.

The socket organizer 10′ illustrated in FIGS. 6-10 is of generally similar design and use to the socket organizer 10 previously described and like reference numerals are used to denote like parts. In this case, however, the organizer is of circular shape with the socket openings 28′ arranged in a circle around the outside of the organizer. Also, in this case, the stops 36′ for the respective receivers 28′ are separate elements and are each provided with an ejector mechanism including a press button 40 and a lever 42 mounted on a post 44 extending inwardly from base wall 14′ of the organizer. It will be evident that the press buttons 40 and the respective stops 36′ are pivotally connected to opposite ends of lever 42 which itself pivots on post 44. The respective press buttons 40 extend through openings 46 in top wall 24′ of the organizer and are arranged in a circle inside of the circle formed by the openings 26′. The stops 36′ may again be of different heights to suit the heights of the respective sockets 12 and it will be evident that depression of the respective press button 40 is effective to elevate the respective stop 36′ thereby ejecting a socket from its respective receiver, while the press button is returned to its elevated position when a socket is inserted into the respective receiver. In other respects, organizer 10′ is constructed and operates in a similar manner to that of the first embodiment.

The foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as new is as follows:

1. An article holder comprising a housing having a wall, an opening in the wall, an article receiver of tubular form supported by the wall with said opening defining an open end of the receiver, the receiver being slit longitudinally to form a plurality of circumferentially spaced segments with the segments being radially expandable and contractable and resiliently resisting radial expansion whereby an article of suitable size inserted into the receiver may resiliently expand the receiver for retention therein by a resilient radial gripping force exerted by said receiver and peripheral contracting means exerting radial inward force on the segments of the receiver.

2. The invention of claim 1 wherein the reciever is of circular cross section tapering radially inwardly from said one end toward the opposite end thereof, said peripheral contracting means including at least one endless band of resilient material surrounding the receiver to exert a radial contracting force.

3. The invention of claim 2 wherein the receiver has a neck portion of increased taper extending from said opening and wherein the band is located substantially adjacent the neck portion.

4. The invention of claim 1 wherein the holder further includes an article stop extending from a base wall into the opposite end of the receiver.

5. The invention of claim 4 including an ejector mechanism for elevating the stop to facilitate removal of an article from the receiver through said opening.

6. The invention of claim 5 wherein the ejector mechanism includes a pushbutton extending into a hollow space through the wall of the holder, and a lever in said hollow space connecting the pushbutton to the stop for upward movement of the stop responsive to depression of the pushbutton.

7. The invention of claim 4 wherein the holder includes plural openings, article receivers, and stops, as aforesaid, for organized receipt of a plurality of different size articles, the respective openings and receivers being sized to retain different size articles of a set and the height of at least some of the stops above the base wall being related to the lengths of selected articles so that the articles each project above the top wall substantially to the same level.

8. The invention as defined in claim 7 wherein the articles comprise a set of wrench sockets.

9. An organizer for a set of articles each of a different size and height, the organizer defining a plurality of article receiving depressions sized respectively to suit the sizes of the respective articles, and wherein the depressions are each of a different depth related to the height of the respective articles for retaining the articles therein with the articles each projecting from their respective depressions to substantially the same level, said organizer including a base wall, a top wall, a hollow space defined between the base wall and top wall, a plurality of openings in the top wall, a plurality of tubular article receivers in said hollow space each extending from one of said openings, and a plurality of stops extending into the respective receivers, such that each receiver, opening and top combination defines one of said depressions, each receiver being slit longitudinally making it radially expandable and contractable, and resilient means embracing each receiver for applying a resilient peripheral contraction force thereon.

10. The invention of claim 9 wherein the receivers are each of circular cross section tapering inwar,Jly from the respective opening to the respective stop, and wherein the resilient means includes at least one endless resilient band encircling each receiver.

11. The invention of claim 9 including an ejector mechanism for each stop for elevating the stop to facilitate removal of an article from the respective receiver.

12. The invention of claim 11 wherein each ejector mechanism comprises a pushbutton extending into said hollow space through the top wall and a lever in said hollow space connecting the respective stop and pushbutton for upward movement of the stop responsive to depression of the pushbutton.

13. The invention of claim 12 wherein the openings and pushuttons are arranged in respective concentric circles with the openings surrounding the pushbuttons.

14. The invention of claim 9 wherein the article receiving depressions are arranged in ascending/descending size order.

* * * * *